United States Patent [19]

Dixon

[11] 4,146,358

[45] Mar. 27, 1979

[54] PYROPHORIC LIGHTER

[75] Inventor: Richard B. Dixon, Reading, England

[73] Assignee: Wilkinson Sword Limited, England

[21] Appl. No.: 734,400

[22] Filed: Oct. 21, 1976

[30] Foreign Application Priority Data

Oct. 27, 1975 [GB] United Kingdom ..... 44086/75

[51] Int. Cl.[2] ..... F23Q 1/02

[52] U.S. Cl. ..... 431/274; 431/254

[58] Field of Search ..... 431/273, 274, 129, 253, 431/254, 275, 276, 277, 344, 135, 136, 137, 138, 139, 140, 141

[56] References Cited

U.S. PATENT DOCUMENTS

| | | | |
|---|---|---|---|
| 2,865,185 | 12/1958 | Gellman | 431/274 |
| 3,733,167 | 5/1973 | Hocq | 431/274 |
| 3,752,637 | 8/1973 | Norman | 431/274 |
| 3,827,852 | 8/1974 | Chevallier | 431/274 |

*Primary Examiner*—Carroll B. Dority, Jr.

*Attorney, Agent, or Firm*—Newton, Hopkins & Ormsby

[57] ABSTRACT

Disclosed herein is a smokers' pyrophoric lighter wherein the usual pawl and ratchet mechanism by which an actuator turns the spark wheel is replaced by a resiliently deformable friction-drive transmitting member, preferably a rubber or like elastomeric pad, the actuator being mounted so that the friction driving member can engage the spark wheel during the operative stroke and idle past the spark wheel on the return stroke.

13 Claims, 7 Drawing Figures

PYROPHORIC LIGHTER

Figure 1:
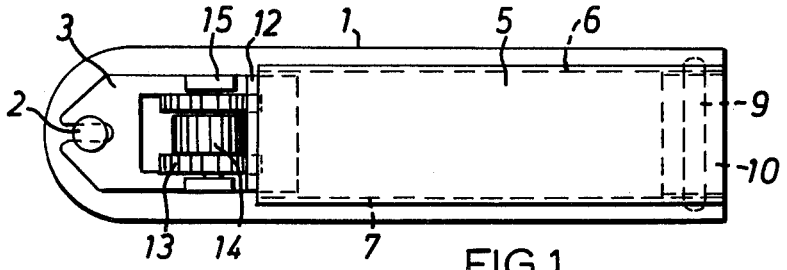

This invention relates to smokers' and like pyrophoric lighters of the type having a so-called flint from which a manually operated abrasive wheel strikes sparks to ignite fuel which, in modern lighters, is a gas, such as butane, which issues from a liquid reservoir through a burner-valve opened by or on completion of the spark wheel operation.

In simple kinds of such lighters the spark wheel is operated by the user's thumb bearing on the wheel, or on side-flanges thereof, and then coming to rest on a burner-valve operating lever.

More elaborate lighters, known as automatic lighters, have a spring-loaded lever, for operation by the user's thumb or forefinger, to turn the spark wheel, through some form of pawl and ratchet mechanism, and open a burner-valve towards the end of the operating lever stroke.

A relatively rapid acceleration or snap action of the spark wheel is required to achieve the speed necessary to project sparks into the path of fuel from the burner. This is usually achieved by the acceleration which follows sudden overcoming of the resistance to initial turning of the wheel provided by the usual spring-loading of the flint against the wheel.

The present invention provides a lighter with an operating mechanism which is simple and has a satisfactory feel in use.

The invention is applied to a pyrophoric lighter having a spark wheel and a manually operable actuator for rotating the spark wheel, the actuator being spring-loaded for a return stroke to a rest position on release after a manual operating stroke from the rest position, and, according to the invention, a resiliently deformable friction-drive transmitting member is provided, to transmit movement of the actuator to the spark wheel, and guiding means are provided to promote frictional driving engagement between the actuator and the spark wheel during the operating stroke and idle movement of the actuator past the spark wheel on the return stroke.

For example, and preferably, a rubber or like elastomeric pad is provided as a friction driving member on a manually operable, spring-loaded lever, or a reciprocating push button, and is arranged to contact and be compressed against the spark wheel by initial movement in the operating stroke, to move with the wheel and become compressed further in frictional rotation of the wheel and then to leave contact with the wheel, recover from compression and return idly to its initial position by a different path on the return stroke.

To provide for an idle return stroke, an actuator lever may have a movable axis, preferably provided by a pin-and-slot pivot, so that the effective length of the lever, that is the distance between the friction driving member and the axis, is reduced on the return stroke of the lever. The provision of a movable axis for the actuator lever, especially in the case of a pin-and-slot, may provide for effective shortening during the working stroke of the lever arm either as an alternative or in addition to compression of a rubber pad.

In the case of the actuator being a reciprocating push-button, it may be slidable in the lighter body on an inclined pin-and-slot mounting to guide the push button along a path further from the spark wheel in the return stroke than in the operating stroke.

In the usual case of a liquid gas lighter, a part of the actuator can be arranged to contact a valve-opening lever at the end of the operating stroke.

It will be apparent that the principle of friction-driving the spark wheel through a resiliently deformable member could be embodied in other constructions. As one example, the resiliently deformable driving member could be formed by elastomeric side flanges on the spark wheel to be encountered by a serrated arcuate end of an actuator lever or other driving part of an actuator.

Figure 2:
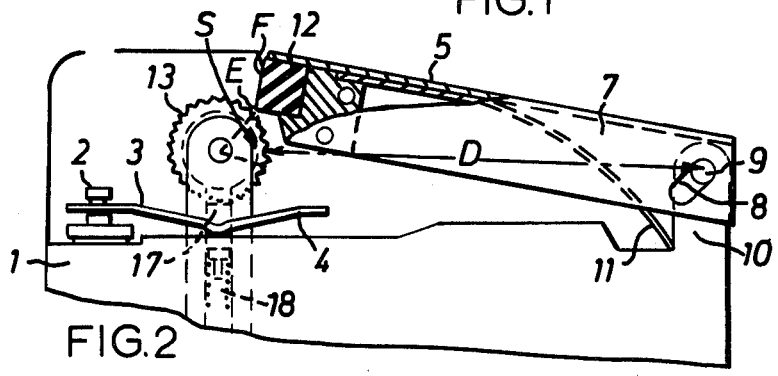
Figure 3:
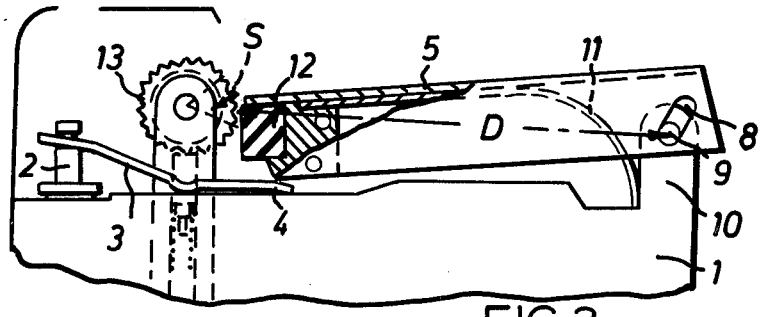
Figure 4:
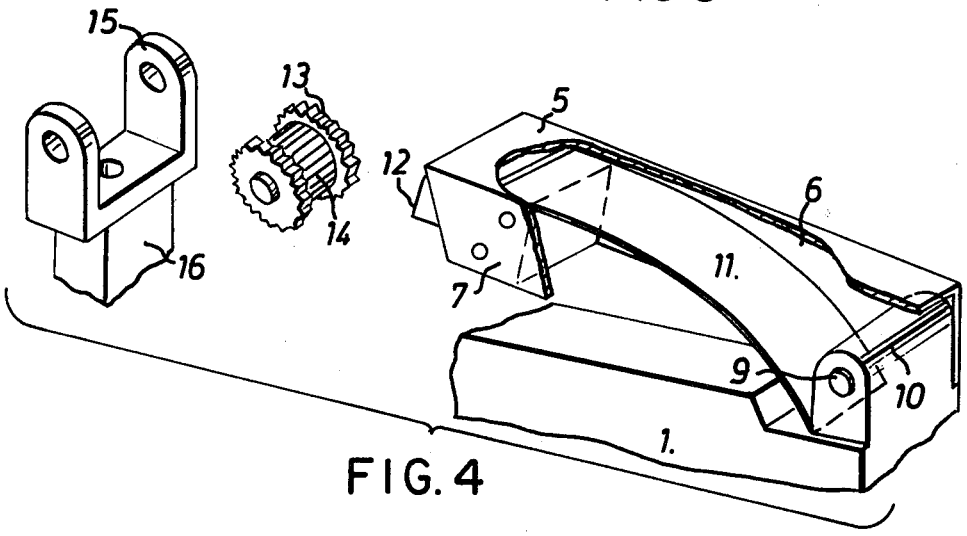
Figure 5:
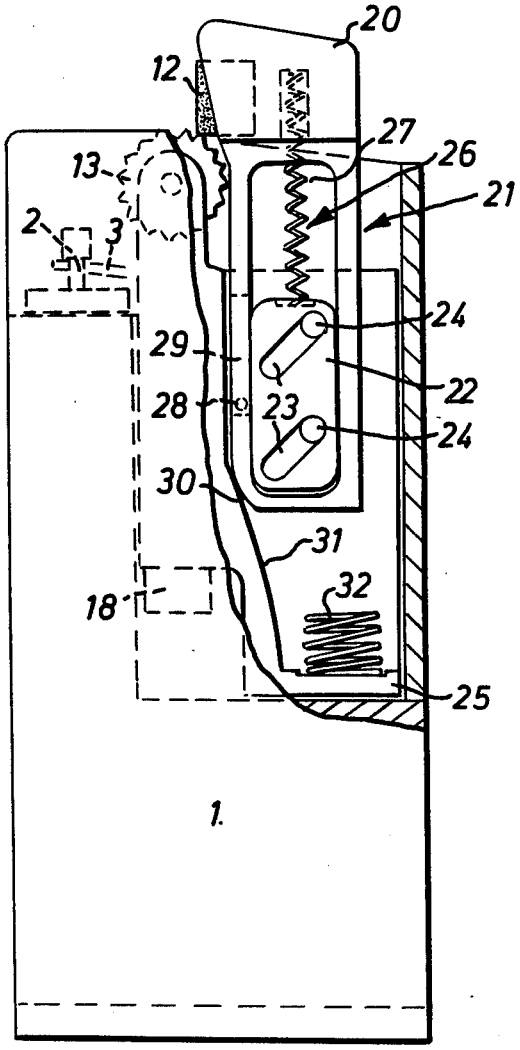
Figure 6:
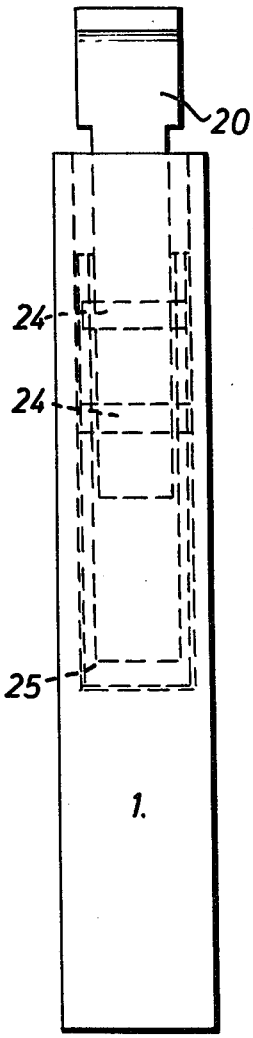
Figure 7:
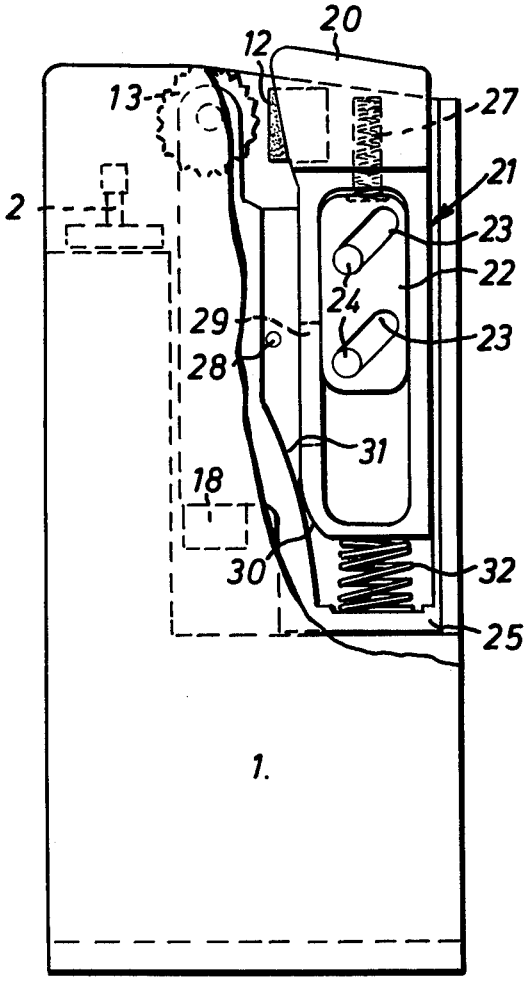

It is however preferred to provide the friction-drive transmitting member as a rubber pad or like elastomeric part of the actuator and two embodiments of this form of the invention will be described, by way of example, with reference to the accompanying drawings, in which:

FIG. 1 is a plan of a lighter with a lever actuator in accordance with the invention, FIG. 2 is a part sectional side elevation of the operating mechanism of the lighter of FIG. 1 in its rest position, FIG. 3 is a view corresponding to FIG. 2 but with the actuator lever depressed at the end of its operating stroke, and FIG. 4 is a fragmentary exploded view of the actuator lever and spark wheel components, FIG. 5 is a partly sectioned front elevation and FIG. 6 is a side elevation of a lighter with a push-button actuator in accordance with the invention, and FIG. 7 is a view corresponding to FIG. 5 but showing the push-button at the end of its operating stroke.

The lighter of FIGS. 1 to 4 will first be described.

The lighter shown has a body 1, providing or containing a liquid gas reservoir, and a valved burner 2 operated by a forked rocking lever 3 the tail 4 of which is encountered by the actuator lever 5 at the end of its operating stroke.

The lever 5 is of inverted channel section with side flanges 6 and 7 which have inclined slots 8 engaged by the ends of a pivot pin 9 journalled in a lug 10 on the lighter body 1.

Within its channel, the lever 5 houses a bowed blade spring 11 the tail of which bears against the lug 10 and constantly loads the lever 5 towards an upper position of rest (FIG. 2) in which the upper ends of the slots 8 bear on the pin 9.

Mounted firmly in the free end of the lever 5 is a hard but resilient rubber pad 12 which projects from the end of the channel of the lever 5 to encounter, as a friction driving member, knurled side flanges 13 of a spark wheel 14 journalled in the cheeks 15 of a U-bracket at the upper end of a flint tube 16 holding the usual flint 17 and loading spring 18.

The operation of the lighter can be seen from FIGS. 2 and 3.

From the upper, rest position of the actuator lever 5, manual depression of the lever brings the rubber pad 12 downwardly against the knurled side flanges 13 of the spark wheel 14 against rotation of which the spring-loaded flint 17 offers appreciable opposition.

First contact of the pad 12 against the spark wheel flanges is by the edge E of a face F which sequentially engages the spark wheel so that the area of frictional driving contact and the degree of compression of the pad increase during an initial part of the operating stroke. Continued firm manual pressure compresses the rubber pad 12 against the flanges 13 until the opposition of the flint is suddenly overcome and the spark wheel is accelerated to abrade the flint and eject a stream of sparks into the path of the gas jet emitted from the burner opened by the valve lever 3 rocked by its tail 4 enountered by the lever 5 at the end of its downward stroke.

It can be seen in FIG. 2 that the initial effective length of the lever 5, from the axis of its pivot pin 9 to the edge E of the pad 12 which first contacts the flanges 13, is greater than the distance D of the axis radially from the driven segment S of the flanges 13 through which the lever operates during its downward stroke.

The effective length of the actuator lever must therefore shorten during the downward stroke and this is provided for by resilient compression of the pad 12 and by movement of the lever axis due to the slots 8 riding up the pin 9.

When the lever 5 is released, with its axis still displaced away from the spark wheel , recovery of the blade spring 11 lifts the free end of the lever for the pad 12 to rise idly past the flanges 13 and then tilts the lever 5, to the extent permitted by the slots 8 running down the pin 9, until the rest position of FIG. 2 is recovered.

The valve lever 3 is freed, as the lever 5 rises, for the burner valve to close.

A push button actuator embodiment of the invention will now be described with reference to FIGS. 5 to 7 in which parts corresponding to parts in FIGS. 1 to 4 have the same reference characters.

A reciprocating push button 20 is mounted to slide in a recess 21 in the lighter body 1 on a bearing in the form of a slider block 22 which has a pair of inclined slots 23, transversely oblique to the direction of reciprocation of the push button, through which slots extend a pair of pins 24 fixed by their ends in the walls of a liner 25 in the body recess 21.

The slider block 22 is a sliding fit in a slot 26 in the push button and a compression spring 27 constantly thrusts the block 22 towards the lower end of the slot 26. When the pins 24 are located in the upper end of the slots 23, as shown in FIG. 5, the thrust of the spring 27 holds the push button in an upper position of rest limited by a fixed pin 28 in a side slot 29 in the push button.

On manual depression of the push button 20, from the position shown in FIG. 5, the rubber pad 12 encounters the spark wheel flanges 13 and a heel 30 of the push button encounters a curved ramp 31 in the liner 25.

Continued firm pressure on the push button produces rotation of the spark wheel, in a similar manner to that described above with reference to FIGS. 1 to 4, and the lower end of the push button also becomes tilted away from the spark wheel with a consequent wedging action on the slider block 22, between the pins 24 and the further wall of the slot 26. This wedging action moves the slider block 22 upwardly in the slot 26, compressing the spring 27, and obliquely upwardly on the pins 24, in the inclined slots 23, with the result that at the end of its operating stroke the push button has moved, with the slider block, away from the spark wheel, as shown in FIG. 7.

On release, the push button is thrust upwardly by the spring 27, making an idle return stroke along a path further from the spark wheel than the path followed by the push button in the downward operating stroke. During the return stroke, the slider block moves obliquely downwardly to bring the push button back to its upper position of rest, as shown in FIG. 5.

To aid initiation of the return stroke, and avoid any tendency for the push button to stick at the bottom of its recess, a buffer compression spring 32 is secured to the base of the liner 25.

I claim:

1. In a pyrophoric lighter having a body, a spark wheel and a spring biased, manually operable actuator mounted on said body, the improvement characterized by said actuator having a resilient deformable friction drive transmitting member fixedly attached at one end thereof, and guide means in said body to control the path of the actuator to maintain contact between the friction drive transmitting member and the periphery of the spark wheel during the operating stroke and to change the path of the actuator to preclude contact between the friction drive transmitting member and the periphery of the spark wheel during the return stroke.

2. In a lighter according to claim 1 and further characterized in that the guide means comprises an inclined pin-and-slot mounting of the actuator in the lighter body.

3. In a lighter according to claim 2 and further characterized in that the actuator is a lever having an inclined pin-and-slot pivotal mounting spring biased for movement of the lever axis to reduce the effective length of the lever, between its pivotal axis and the spark wheel, during the return stroke.

4. In a lighter according to claim 3 and further characterized in that the pin-and-slot mounting of the lever permits reduction of the effective length of the lever, against the action of the spring biasing, to enable the lever to accelerate rapidly, with a snap action, during the initial portion of the operating stroke.

5. A pyrophoric lighter having a spark wheel and a manually operable actuator for rotating the spark wheel, the actuator being spring-loaded for a return stroke to a rest position on release after a manual operating stroke from the rest position, in which a resiliently deformable friction-drive transmitting member is provided, to transmit movement of the actuator to the spark wheel, and guiding means being provided to promote frictional driving engagement between the actuator and the spark wheel during the operating stroke and idle movement of the actuator past the spark wheel on the return stroke, said guiding means being an inclined pin-and-slot mounting of the actuator in the lighter body, said actuator being a lever having an inclined pin-and-slot pivotal mounting spring-loaded for movement of the lever axis to reduce the effective length of the lever, between its pivotal axis and the spark wheel, for the idle return stroke of the lever, the pin-and-slot pivotal mounting of the lever permitting reduction of the effective length of the lever, against the effect of the spring loading, so as to enable the lever to accelerate rapidly, with a snap action, during the operating stroke, said friction-drive transmitting member being a rubber pad or like elastomeric part of the actuator.

6. A lighter according to claim 5 in which the elastomeric part of the actuator is shaped to present to the spark wheel an edge and a face for sequential engagement with the spark wheel so that the area of frictional driving contact and the degree of compression of the elastomeric part increase during an initial part of the operating stroke.

7. A lighter according to claim 6, in which the elastomeric part is a pad which, in the rest position of the actuator, presents close to the spark wheel an edge of a face of the pad which contacts the spark wheel during the operating stroke.

8. In a lighter according to claim 2 and further characterized in that the actuator is a reciprocating push button slideably mounted in the lighter body on an inclined pin-and-slot guide means to direct the path of the push button further away from the spark wheel on the return stroke than on the operating stroke.

9. In a lighter according to claim 8 and further characterized in that the push button mounting comprises a bearing member on which the push button is mounted and said bearing member further has a pin-and-slot mounting in the lighter body for movement away from the spark wheel during the return stroke.

10. In a lighter according to claim 9 and further characterized in that the bearing member is a slider internally positioned in and guiding the push button and said slider is mounted on pins fixed to the lighter body which engage oblique slots in the slider.

11. A pyrophoric lighter having a spark wheel and a manually operable actuator for rotating the spark wheel, the actuator being spring-loaded for a return stroke to a rest position on release after a manual operating stroke from the rest position, in which a resiliently deformable friction-drive transmitting member is provided, to transmit movement of the actuator to the spark wheel, and guiding means being provided to promote frictional driving engagement between the actuator and the spark wheel during the operating stroke and idle movement of the actuator past the spark wheel on the return stroke, said guiding means being an inclined pin-and-slot mounting of the actuator in the lighter body, said actuator being a reciprocating push button slidable in the lighter body on an inclined pin-and-slot mounting to guide the push button along a path further from the spark wheel in the return stroke than in the operating stroke, said push button mounting including a bearing on which the push button is slideable and the bearing having a pin-and-slot mounting in the lighter body for movement away from the spark wheel for the idle return stroke, the bearing being a slider in the push button and being obliquely slotted for relatively fixed pin mounting in the lighter body, the friction-drive transmitting member being a rubber pad or like elastomeric part of the actuator.

12. A lighter according to claim 11, in which the elastomeric part of the actuator is shaped to present to the spark wheel an edge and a face for sequential engagement with the spark wheel so that the area of frictional driving contact and the degree of compression of the elastomeric part increase during an initial part of the operating stroke.

13. A lighter according to claim 12, in which the elastomeric part is a pad which, in the rest position of the actuator, presents close to the spark wheel an edge of a face of the pad which contacts the spark wheel during the operating stroke.

* * * * *